US012364300B2

(12) United States Patent
Cody

(10) Patent No.: US 12,364,300 B2
(45) Date of Patent: Jul. 22, 2025

(54) INSULATING FILL MATERIAL COMPOSITION AND METHODS OF PREPARATION

(71) Applicant: Paka Apparel Inc, Austin, TX (US)

(72) Inventor: Kristopher Cody, Austin, TX (US)

( * ) Notice: Subject to any disclaimer, the term of this patent is extended or adjusted under 35 U.S.C. 154(b) by 290 days.

(21) Appl. No.: 17/943,717

(22) Filed: Sep. 13, 2022

(65) Prior Publication Data

US 2024/0081452 A1 Mar. 14, 2024

(51) Int. Cl.

| | |
|---|---|
| ***A41D 31/06*** | (2019.01) |
| ***D01G 13/00*** | (2006.01) |
| ***D01G 21/00*** | (2006.01) |
| ***D04H 1/425*** | (2012.01) |
| ***D04H 1/435*** | (2012.01) |
| ***D04H 1/541*** | (2012.01) |
| ***D04H 1/64*** | (2012.01) |

(52) U.S. Cl.

CPC ..... *A41D 31/065* (2019.02); *D01G 13/00* (2013.01); *D01G 21/00* (2013.01); *D04H 1/425* (2013.01); *D04H 1/435* (2013.01); *D04H 1/541* (2013.01); *D04H 1/64* (2013.01)

(58) Field of Classification Search

CPC ..... D01G 13/00; D01G 21/00
USPC ..... 19/145, 145.5, 145.7, 296
See application file for complete search history.

(56) References Cited

U.S. PATENT DOCUMENTS

| | | | | |
|---|---|---|---|---|
| 5,217,780 | A | 6/1993 | Wurzer | |
| 6,836,974 | B1 | 1/2005 | Pettigrew et al. | |
| 7,882,687 | B2 | 2/2011 | Blitstein et al. | |
| 9,527,227 | B1 * | 12/2016 | Anderle | B29C 43/34 |
| 9,586,745 | B1 | 3/2017 | Givler | |
| 9,731,436 | B2 | 8/2017 | Anderle et al. | |
| 2006/0172649 | A1 * | 8/2006 | Knoff | D04H 1/425 428/920 |
| 2015/0208752 | A1 | 7/2015 | Licklider et al. | |
| 2016/0355958 | A1 * | 12/2016 | Grynaeus | D04H 1/00 |
| 2017/0057126 | A1 * | 3/2017 | Anderle | D01G 21/00 |
| 2017/0362755 | A1 * | 12/2017 | Mason | D04H 1/5418 |

FOREIGN PATENT DOCUMENTS

| | | | |
|---|---|---|---|
| WO | WO2020240384 | 3/2020 | |
| WO | WO-2020187568 A1 * | 9/2020 | D01G 21/00 |

* cited by examiner

*Primary Examiner* — Aiying Zhao

(57) ABSTRACT

An insulating fill material composition for use in outerwear, sleeping bags, bedding, and the like includes 40.0 to 85.0 wt % alpaca fibers, 10.0 to 20.0 wt % bicomponent fibers, and 5.0 to 40.0 wt % polyester fibers. The alpaca fibers have a length of 40.0 to 70.0 mm. The bicomponent fibers have a length of 40.0 mm to 60.0 mm and a linear mass density of 0.11 to 0.33 mg/m. The polyester fibers have a length of 40.0 mm to 60.0 mm and a linear mass density of 0.22 to 0.44 mg/m. Blending, combing, carding, and lapping of the alpaca fibers, the bicomponent fibers, and the polyester fibers forms a matte, which when needled and heated forms a batting having a weight of 50.0 to 400.0 g/m$^2$.

3 Claims, No Drawings

INSULATING FILL MATERIAL COMPOSITION AND METHODS OF PREPARATION

(b) CROSS-REFERENCE TO RELATED APPLICATIONS

(c) Statement Regarding Federally Sponsored Research or Development

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to insulating compositions and more particularly pertains to a new insulating composition for use in outerwear, sleeping bags, bedding, and the like. The present invention discloses an insulating composition utilizing alpaca fibers cut to a specific length, which renders them usable in creating battings.

(2) Description of Related Art Including Information Disclosed Under 37 CFR 1.97 and 1.98

The prior art relates to insulating compositions, which may comprise methods of manufacturing composite alpaca fibers yarn. Related prior art includes fabrics that comprise alpaca fibers, blended alpaca fibers and polyester pads. What is lacking in the prior art is an insulating composition comprising cut alpaca fibers having a length being less than about 60 mm that, when and combined with other fibers, creates a composition having superior insulation characteristics while remaining surprisingly lightweight and voluminous.

(h) BRIEF SUMMARY OF THE INVENTION

An embodiment of the disclosure meets the needs presented above by generally comprising 40.0 to 85.0 wt % alpaca fibers, 10.0 to 20.0 wt % bicomponent fibers, and 5.0 to 40.0 wt % polyester fibers. The alpaca fibers have a length of 40.0 to 70.0 mm. The bicomponent fibers have a length of 40.0 mm to 60.0 mm and a linear mass density of 0.11 to 0.33 mg/m. The polyester fibers have a length of 40.0 mm to 60.0 mm and a linear mass density of 0.22 to 0.44 mg/m. Blending, combing, carding, and lapping of the alpaca fibers, the bicomponent fibers, and the polyester fibers forms a matte, which when needled and heated forms a batting having a weight of 40.0 to 400.0 g/m$^2$.

In another embodiment, a batting, having a weight of 40.0 to 400.0 g/m$^2$ is comprised of 40.0 to 85.0 wt % alpaca fibers having a length of 40.0 to 70.0 mm, 10.0 to 20.0 wt % bicomponent fibers, and 5.0 to 40.0 wt % polyester fibers.

Another embodiment of the disclosure includes a method comprising a provision step, wherein the component fibers listed above are provided, a blending and combing step, wherein the component fibers are homogenized, a carding step, wherein the alpaca fibers, the bicomponent fibers, and the polyester fibers are substantially aligned to form a web of fibers, a lapping step, wherein the web of fibers is lapped to form a matte, a needling step, wherein the component fibers are entangled, and a heating step, wherein the matte is heated to melt at least one component of the bicomponent fibers to generate a batting.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

Not applicable

(j) DETAILED DESCRIPTION OF THE INVENTION

An insulating fill material composition generally comprises 40.0 to 85.0 wt % alpaca fibers, 10.0 to 20.0 wt % bicomponent fibers, and 5.0 to 40.0 wt % polyester fibers, referred to collectively as component fibers. The composition is combined in conventional methods to form a batting, fill, wadding and like, i.e. nonwoven fabric. Generally, blending, combing, carding, and lapping of the alpaca fibers, the bicomponent fibers, and the polyester fibers forms a matte, which, when needled and heated, forms a batting having a weight of 40.0 to 400.0 g/m$^2$. Blending, combing, carding, lapping, and needling are processes well known to those skilled in the arts of textile manufacturing and batting production and can be performed on equipment equally well known to those skilled in these arts. Furthermore, the composition is not reliant on all steps indicated above to form the matte and the batting.

Alpaca fibers have medullated air pockets that function to enhance the insulating power of the batting, while keeping it lightweight. The alpaca fibers of the present invention have a length of 40.0 to 70.0 mm and may comprise one or both of huacaya fibers and surf fibers, which have average staple lengths of 75 to 125 mm and 150 to 205 mm, respectively. The alpaca fibers of the present invention are prepared from raw alpaca fibers by washing, combing, and then creating what are called tops, which then are cut to a desired length using a standard cutting machine. After cutting, the alpaca fibers then are pre-opened, using standard methods well known to those skilled in the art, before blending and combing them with the other component fibers.

Previous attempts at using full staple length alpaca fibers in battings suffered from a tendency of the full staple length alpaca fibers to lock up carding machines that are used in the production process and insulating fills that were subject to loss of loft, a starting volume of a batting prior to compression. A key aspect of the present invention is the use of alpaca fibers having a length of 40.0 to 70.0 mm. Alpaca fibers of this length, which have not previously been disclosed, allow the batting to retain its loft, as the alpaca fibers are oriented in numerous directions within the batting.

The bicomponent fibers have a length of 40.0 mm to 60.0 mm and a linear mass density of 0.11 to 0.33 mg/m. A traditional and common unit of linear mass density for fibers is the denier, wherein 1 denier is equivalent to 0.11 mg/m and therefore the linear mass density of the bicomponent fibers would be 1 to 3 deniers. The denier is defined by a single strand of silk, used as a referenced, wherein 9000 m has a weight of one gram. Therefore, (1 g/9000 m)× (1000 mg/g)=1 mg/9 m, which equals approximately 0.11 mg/m. Within this document it should be understood that each unit of 0.11 mg/m may be interchanged with 1 denier.

Bicomponent fibers are available in a variety of compositions, all of which are anticipated by the present invention. These include, but are not limited to, bicomponent fibers having copolyester sheathed polyester cores, polyethylene sheathed polyester cores, polypropylene sheathed polyethylene core, and the like. The bicomponent fibers function to bind the other component fibers of the insulating composition. As the matte is heated, the bicomponent fibers melt and bond to the other component fibers together, thereby ensuring production of a batting that possesses structural integrity, stability, and durability.

In one embodiment, the polyester fibers have a length of 40.0 mm to 60.0 mm and a linear mass density of 0.22 to 0.44 mg/m. Polyester fiber, in the context of this disclosure, should be interpreted to mean any natural polyester, synthetic polyester, or polyester substitute, such as, but not limited to, polylactic acid. Polyactic acid, or PLA, are often referred to as bio-based fibers as they are derived from renewable, organic sources such as corn start or sugar cane. The relatively thin polyester fibers enhance the effective thermal insulation of the batting.

The component fibers of the insulating fill material composition also may comprise 5.0 to 15.0 wt % of polyester fiber having a linear mass density of 0.45 to 0.88 mg/m. The polyester fiber may have a length of 40.0 mm to 60.0 mm, may be a continuous polyester filament, or a combination thereof. The relatively thick polyester fibers and/or continuous polyester filaments enhance resilience of the batting in recovering from compression, allowing the batting to "bounce" back and recover its original thickness. These relatively thick polyester fibers and/or continuous polyester filaments are optionally included in the insulating fill material composition to improve durability of the batting. The present invention also anticipates using alpaca fibers up to full staple length and at a relatively low wt %, as doing so does not negatively impact the production process.

The component fibers of the insulating fill material composition also may comprise 10.0 to 20.0 wt % hollow conjugated siliconized fibers having a length of 50.0 mm to 80.0 mm and a linear mass density of 0.55 to 1.00 mg/m. The linear mass density of the hollow conjugated siliconized fibers enables resilient compression of the batting in three dimensions and recovery of loft over time. Additionally, in being hollow, the hollow conjugated siliconized fibers enhance the effective thermal insulation of the batting.

The insulating fill material composition also may comprise 2.0 to 4.0 wt % glycidyl methacrylate, or a solution thereof, which is applied to each of opposed faces of the matte prior to and/or during the heating of the matte to form the batting. The 2.0 to 4.0 wt % glycidyl methacrylate, or the solution thereof, also may be applied to opposed sides of the matte. In one embodiment, the glycidyl methacrylate is sprayed on one of the opposed faces of the matte to 3.0 wt % and the matte is heated, which activates and dries the glycidyl methacrylate. Then, the glycidyl methacrylate is sprayed on the other of the opposed faces of the matte to 3.0 wt % and the matte is again heated. The glycidyl methacrylate reacts with exposed elements of the component fibers used in production of the matte, stabilizing the component fibers to maintain long-term integrity of the batting, to minimize tearing of the batting, and to prevent migration of the component fibers.

The insulating fill material composition also may comprise a solution of an antistatic compound, which is sprayed upon the alpaca fibers, the bicomponent fibers, and the polyester fibers during one or more of the blending, the combing, the carding, the lapping, and the needling. In addition to antistatic compounds well known to those skilled in the art of textile manufacturing, such as, but not limited to, long-chain aliphatic amines and amides, quaternary ammonium salts, esters of phosphoric acid, polyethylene glycol esters, polyols, and the like, the present invention anticipates use of electrically powered ionizing bars to neutralize static during production of the matte.

In one example, the insulating fill material composition comprises 40.0 to 60.0 wt % alpaca fibers having a length of 45.0 to 60.0 mm, 10.0 to 20.0 wt % bicomponent fibers having a length of 40.0 mm to 60.0 mm and a linear mass density of 0.11 to 0.33 mg/m, 5.0 to 15.0 wt % polyester fibers having a length of 40.0 mm to 60.0 mm and a linear mass density of 0.22 to 0.44 mg/m, 5.0 to 15.0 wt % polyester fibers having a linear mass density of 0.45 to 0.88 mg/m and being 40.0 mm to 60.0 mm in length, continuous polyester filaments, or a combination thereof, 10.0 to 20.0 wt % hollow conjugated siliconized fibers having a length of 50.0 mm to 80.0 mm and a linear mass density of 0.55 to 1.00 mg/m, and 2.0 to 4.0 wt % glycidyl methacrylate applied to each of opposed faces of the matte prior to and/or during heating of the matte to form the batting.

In another example, the insulating fill material composition comprises 48.0 to 52.0 wt % alpaca fibers having a length of 45 to 60 mm, 14.0 to 16.0 wt % bicomponent fibers having a length of 40.0 mm to 60.0 mm and a linear mass density of 0.11 to 0.33 mg/m, 9.0 to 11.0 wt % polyester fibers having a length of 40.0 mm to 60.0 mm and a linear mass density of 0.22 to 0.44 mg/m, 9.0 to 11.0 wt % polyester fibers having a linear mass density of 0.45 to 0.88 mg/m and being 40.0 mm to 60.0 mm in length, continuous polyester filaments, or a combination thereof, 14.0 to 16.0 wt % hollow conjugated siliconized fibers having a length of 50.0 mm to 80.0 mm and a linear mass density of 0.55 to 1.00 mg/m, and 2.8 to 3.2 wt % powdered glycidyl methacrylate applied to each of the opposed faces of the matte prior to and/or during the heating of the matte to form the batting.

In yet another example, the insulating fill material composition comprises 40.0 to 60.0 wt % alpaca fibers having a length of 53.0 to 57.0 mm, 10.0 to 20.0 wt % bicomponent fibers having a length of 50.0 to 52.0 mm and a linear mass density of 0.11 to 0.33 mg/m, 5.0 to 15.0 wt % polyester fibers having a length of 50.0 to 52.0 mm and a linear mass density of 0.22 to 0.44 mg/m, 5.0 to 15.0 wt % polyester fibers having a linear mass density of 0.45 to 0.88 mg/m and being 50.0 to 52.0 mm in length, continuous polyester filaments, or a combination thereof, 10.0 to 20.0 wt % hollow conjugated siliconized fibers having a length of 60.0 to 65.0 mm and a linear mass density of 0.55 to 1.00 mg/m, and 2.0 to 4.0 wt % glycidyl methacrylate applied to each of the opposed faces of the matte prior to and/or during the heating of the matte to form the batting.

In still yet another example, the insulating fill material composition comprises 40.0 to 60.0 wt % alpaca fibers having a length of 45 to 60 mm, 10.0 to 20.0 wt % bicomponent fibers having a length of 40.0 mm to 60.0 mm and a linear mass density of 0.20 to 0.24 mg/m, 5.0 to 15.0 wt % polyester fibers having a length of 40.0 mm to 60.0 mm and a linear mass density of 0.30 to 0.36 mg/m, 5.0 to 15.0 wt % polyester fibers having a linear mass density of 0.60 to 0.70 mg/ma and being 40.0 mm to 60.0 mm in length, continuous polyester filaments, or a combination thereof, 10.0 to 20.0 wt % hollow conjugated siliconized fibers having a length of 50.0 mm to 80.0 mm and a linear mass density of 0.70 to 0.80 mg/m, and 2.0 to 4.0 wt % glycidyl methacrylate applied to each of the opposed faces of the matte prior to and/or during heating of the matte to form the batting.

In still yet another example, the insulating fill material composition comprises 48.0 to 52.0 wt % alpaca fibers having a length of 53.0 to 57.0 mm, 14.0 to 16.0 wt % bicomponent fibers having a length of 50.0 to 52.0 mm and a linear mass density of 0.20 to 0.24 mg/m, 9.0 to 11.0 wt % polyester fibers having a length of 50.0 to 52.0 mm and a linear mass density of 0.30 to 0.36 mg/m, 9.0 to 11.0 wt % polyester fibers having a linear mass density of 0.60 to 0.70 mg/m and being 50.0 to 52.0 mm in length, continuous polyester filaments, or a combination thereof, 14.0 to 16.0 wt % hollow conjugated siliconized fibers having a length of 60.0 to 65.0 mm and a linear mass density of 0.70 to 0.80 mg/m, and 2.8 to 3.2 wt % glycidyl methacrylate applied to each of the opposed faces of the matte prior to and/or during the heating of the matte to form the batting.

The matte of the present invention, upon heating, forms a batting having a weight of 60.0 to 400.0 g/m$^2$ and a thickness of 12.7 to 203.2 mm. The batting may have a thickness of 25.4 to 125.0 mm or a thickness of 35.0 to 40.0 mm. The thickness obtained for the batting depends on the thickness of the matte, which is controlled by adjusting a number of times that the web of fibers created by carding is lapped. The batting created is a high-loft and lightweight alpaca fiber based insulating composition applicable for use in the apparel and bedding industries, providing lightweight and thermoregulating insulation as a natural and more functional alternative to the traditional down insulation and synthetic insulation.

The present invention includes a method of preparing an insulating fill material composition comprising a provision step of providing an insulating fill material composition comprised of 40.0 to 85.0 wt % alpaca fibers, 10.0 to 20.0 wt % bicomponent fibers, and 5.0 to 40.0 wt % polyester fibers. The alpaca fibers have a length of 40.0 to 70.0 mm. The bicomponent fibers have a length of 40.0 mm to 60.0 mm and a linear mass density of 0.11 to 0.33 mg/m. The polyester fibers have a length of 40.0 mm to 60.0 mm and a linear mass density of 0.22 to 0.44 mg/m. In a blending and combing step, the alpaca fibers, the bicomponent fibers, and the polyester fibers are blended and combed to form a substantially homogeneous mixture. The alpaca fibers, the bicomponent fibers, and the polyester fibers of the substantially homogeneous mixture are substantially aligned in a carding step of the method to create a web of fibers.

A lapping step of the method laps the web of fibers to form a matte. Lapping may be performed using an oscillating conveyor, which layers the web of fibers in a zig-zag, sideways manner. This cross-lapping produces the matte and intermixes the component fibers. In a needling step, the matte then moves through a needle lomb, which entangles the component fibers. Finally, a heating step of the method entails passage of the matte through an oven, which melts at least one component of the bicomponent fibers, generating a batting from the matte. In one example, the oven is heated to 165 to 170° C.

The insulating fill material composition used in the method also may comprise polyester fibers having a linear mass density of 0.45 to 0.88 mg/m and being 40.0 mm to 60.0 mm in length, continuous polyester filaments, or a combination thereof, along with 10.0 to 20.0 wt % hollow conjugated siliconized fibers having a length of 50.0 mm to 80.0 mm and a linear mass density of 0.55 to 1.00 mg/m.

The method also may include the additional steps of providing a solution of an antistatic compound and spraying of the solution of the antistatic compound onto the alpaca fibers, the bicomponent fibers, and the polyester fibers during the blending and combing step, and/or onto the substantially homogeneous mixture during the carding step, and/or onto the web of fibers during the lapping step.

The method also may include the additional steps of providing glycidyl methacrylate, or a solution thereof, and spraying the glycidyl methacrylate, or the solution thereof, onto each opposed face of the matte prior to and/or during heating of the matte.

In a particular embodiment, the method above was employed using 50.0 wt % alpaca fibers having a length of 55.0 mm, 15.0 wt % bicomponent fibers having a length of 50.8 mm and a linear mass density of 0.22 mg/m, 9.0 to 11.0 wt % polyester fibers having a length of 50.8 mm and a linear mass density of 0.33 mg/m, 10.0 wt % polyester fibers having a length of 50.8 mm and a linear mass density of 0.66 mg/m, 15.0 wt % hollow conjugated siliconized fibers having a length of 63.5 mm and a linear mass density of 0.77 mg/m, and 3.0 wt % glycidyl methacrylate applied to each of the opposed faces of the matte. The batting obtained had a density of 135 g/m$^2$. Testing performed by the International Down and Feather Testing Laboratory provided a CLO value of 2.59 for the batting. CLO is a measure of the ability of a material, such as the batting, to keep a user warm.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A method of preparing an insulating fill material composition comprising the steps of:

providing insulating fill material components comprising:

40.0 to 85.0 wt % alpaca fibers having a length of 40.0 to 70.0 mm, 10.0 to 20.0 wt % bicomponent fibers having a length of 40.0 mm to 60.0 mm and a linear mass density of 0.11 to 0.33 mg/m, and 5.0 to 40.0 wt % polyester fibers having a length of 40.0 mm to 60.0 mm and a linear mass density of 0.22 to 0.44 mg/m;

blending and combing the alpaca fibers, the bicomponent fibers, and the polyester fibers to form a substantially homogeneous mixture;

carding the substantially homogeneous mixture to substantially align the alpaca fibers, the bicomponent fibers, and the polyester fibers to create a web of fibers;

lapping the web of fibers to form a matte;

needling the matte to entangle the alpaca fibers, the bicomponent fibers, and the polyester fibers;

heating the matte to form a batting;

providing a solution of an antistatic compound; and spraying the solution of the antistatic compound onto the alpaca fibers, the bicomponent fibers, and the polyester fibers during the blending and combing step, onto the substantially homogeneous mixture during the carding step, and onto the web of fibers during the lapping step.

2. The method of preparing an insulating fill material composition of claim 1, further including the insulating fill material components comprising one or both of:

5.0 to 15.0 wt % polyester fibers having a linear mass density of 0.45 to 0.88 mg/m and being 40.0 mm to 60.0 mm in length, continuous polyester filaments, or a combination thereof; and 10.0 to 20.0 wt % hollow conjugated siliconized fibers having a length of 50.0 mm to 80.0 mm and a linear mass density of 0.55 to 1.00 mg/m.

3. A method of preparing an insulating fill material composition comprising the steps of:

providing insulating fill material components comprising:

40.0 to 85.0 wt % alpaca fibers having a length of 40.0 to 70.0 mm, 10.0 to 20.0 wt % bicomponent fibers having a length of 40.0 mm to 60.0 mm and a linear mass density of 0.11 to 0.33 mg/m, and 5.0 to 40.0 wt % polyester fibers having a length of 40.0 mm to 60.0 mm and a linear mass density of 0.22 to 0.44 mg/m;

blending and combing the alpaca fibers, the bicomponent fibers, and the polyester fibers to form a substantially homogeneous mixture;

carding the substantially homogeneous mixture to substantially align the alpaca fibers, the bicomponent fibers, and the polyester fibers to create a web of fibers;

lapping the web of fibers to form a matte;

needling the matte to entangle the alpaca fibers, the bicomponent fibers, and the polyester fibers;

heating the matte to form a batting;

providing glycidyl methacrylate or a solution thereof; and spraying the glycidyl methacrylate or the solution thereof onto each opposed face of the matte prior to and/or during heating of the matte.

* * * * *